US006053498A

United States Patent [19]

Waychoff

[11] Patent Number: 6,053,498

[45] Date of Patent: Apr. 25, 2000

[54] GAME USING PLAYING CARDS, GRAB ITEMS, AND BODY APPENDAGES

[76] Inventor: Challen W. Waychoff, 58 Knox La., Wheeling, W. Va. 26003

[21] Appl. No.: 08/976,500

[22] Filed: Nov. 24, 1997

[51] Int. Cl.[7] ..... A63F 1/00

[52] U.S. Cl. ..... 273/292; 273/304

[58] Field of Search ..... 273/292, 303, 273/304, 305, 308

[56] References Cited

U.S. PATENT DOCUMENTS

| | | |
|---|---|---|
| 832,005 | 9/1906 | Atkinson . |
| 1,060,900 | 5/1913 | Hobbs . |
| 1,583,223 | 5/1926 | Cooke . |
| 3,159,403 | 12/1964 | Glass et al. . |
| 3,524,645 | 8/1970 | Breslow . |
| 4,327,911 | 5/1982 | Ptaszek et al. . |

OTHER PUBLICATIONS

*Scarne's Encyclopedia of Games,* "Donkey" and "Pig", Harper and Row, pp. 362–363 © 1973, Dec. 1973.

*Primary Examiner*—Sam Rimell
*Attorney, Agent, or Firm*—Rothwell, Figg, Ernst & Kurz

[57] ABSTRACT

A unique game involving card playing, quickness, and costumery. The game combines elements of the card game "Fish" in that part of the object is to accumulate a complete set of like cards. The game also incorporates aspects similar to "Musical Chairs" in that when a certain event occurs, e.g., when one of the players accumulates a complete set of like card, all of the players grab for a grab item. With one less grab item being available than the number of players, one of the players will not get one. Players unable to grab a grab item are penalized by sequentially being required to put on and wear funny items such as fake pig's noses and ears.

7 Claims, 1 Drawing Sheet

FIGURE
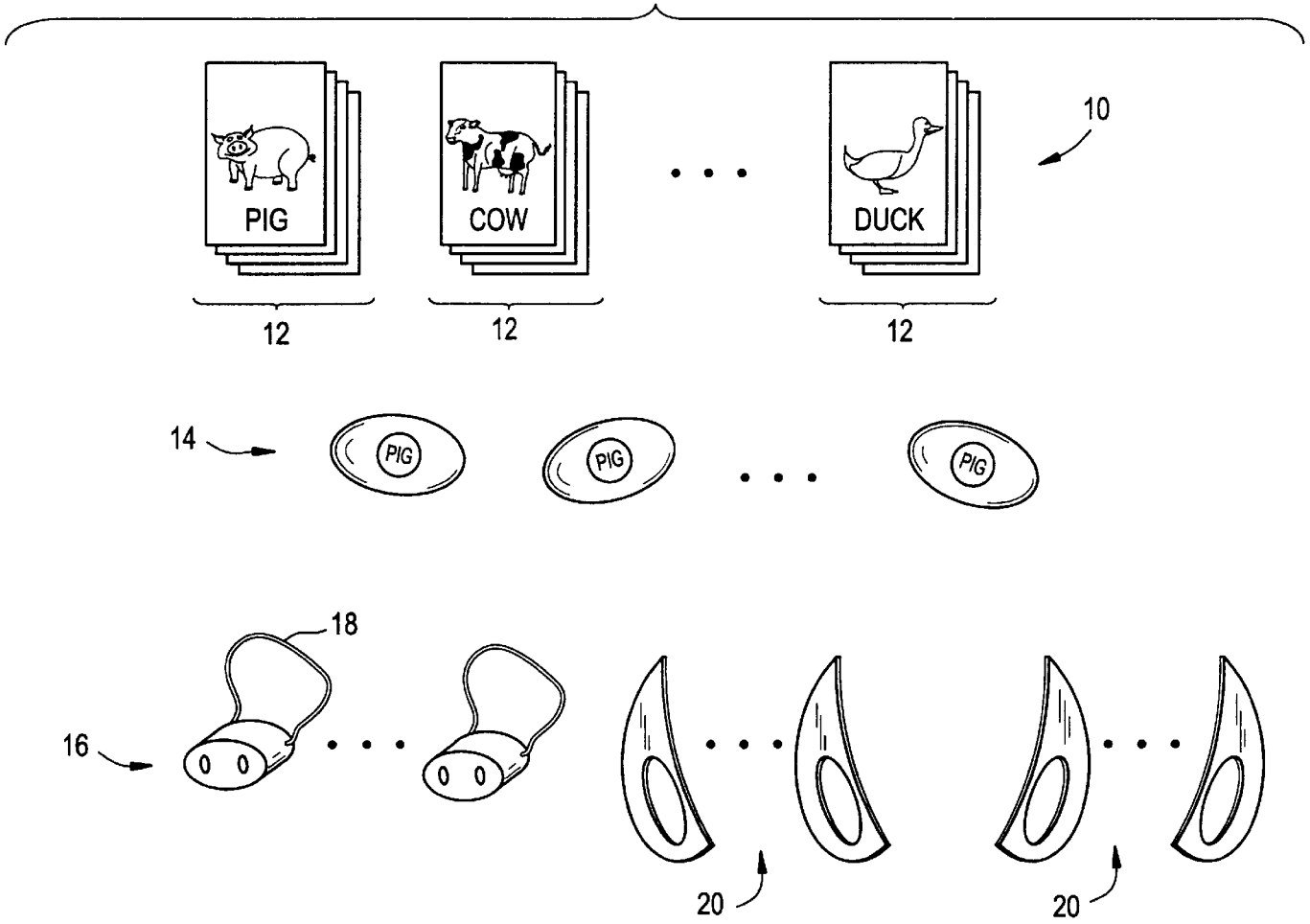

GAME USING PLAYING CARDS, GRAB ITEMS, AND BODY APPENDAGES

BACKGROUND OF THE INVENTION

1. Field of the Invention

The invention relates generally to a game useful for entertainment. In particular, the invention relates to a game using cards, moveable grab items, and animal appendages that can be placed upon and worn by the players.

2. Description of the Background Art

Numerous games have been developed to facilitate enjoyment. One such game is disclosed in U.S. Pat. No. 1,060,900. The U.S. Pat. No. 1,060,900 patent discloses a game which utilizes cards with pictures of different animals. Another such game is disclosed in U.S. Pat. No. 3,524,645. The U.S. Pat. No. 3,524,645 discloses the use of a card holding apparatus, which is configured to be worn on a player's forehead, in combination with a deck of playing cards. A third game is disclosed in U.S. Pat. 3,159,403. The U.S. Pat. No. 3,159,403 discloses the use of individually movable playing pieces that are configured to be stacked upon one another.

SUMMARY OF THE INVENTION

The present invention is a multi-faceted game which combines card-playing skills, quickness, and costumery into one game. In particular, the apparatus for playing the game according to the invention includes a deck of game cards, a number of grab items, and a number of sets of items to be placed on the body and worn as a penalty, one item at a time until being eliminated from the game. The cards are marked with indica and are subdivided into groups with the cards in a given group each bearing the same indicia.

In preferred embodiments, the indicia on the cards are farm animals, and the items put on and worn upon the body are animal appendages, e.g., a pig nose and ears.

To play the game, the cards are distributed among the players and are passed between the players until one of the players accumulates all of the cards of a given group. At that point, the player who has accumulated all of the cards in a given a group grabs for one of the grab items, and the other players grab for one of the grab items as well. Because the number of grab items used is one less than the number of players playing the game, one of the players will not be able to grab a grab item and that player is "penalized" by being required to put on and wear one of the costume items. Play is then repeated until a player has accumulated a predetermined number of the costume items, at which point that player is out of the game. The number of grab items available to be grabbed is then reduced by one, and preferably the number of groups of cards present in the deck of cards being used —preferably equal to the number of players playing at a given point in time—is also reduced by one.

Thus, in one aspect, the invention provides a method of playing a game in which a number of hand-grabbable grab items are placed where they can be reached by all players, with the number of grab items present being one less than the number of players playing the game. Upon the occurrence of a predetermined event, each of the players tries to grab one of the grab items, with all but one of the players actually being able to grab a grab item. The player that is not able to grab a grab item is assigned a penalty, the penalty being that that player has to put on and wear a wearable item, i.e., a piece of the costume.

In another aspect, the invention is a method of playing a game in which a number of hand-grabbable items are placed where they can be reached by all of the players, there being one less grab item available than the number of players present. A deck of game cards is provided, with the deck being subdivided into groups of game cards wherein each of the game cards in a given group bears the same indicia. The players pass the game cards among themselves until one of the players has all of the game cards in a given group, at which point, that player reaches for one of the grab items. At this point, all of the other players try to grab one of the grab items, with all but one of the players being able to grab one. The player unable to grab a grab item is assigned a penalty.

In preferred embodiments of the invention according to either of these two aspects, the penalty consists of being required to put on and wear replicas of animal appendages, e.g., a pig nose and pig ears. When a player accumulates a predetermined number of penalties, e.g., the player has been required to put on and wear all of the pig appendages, that player is eliminated and the game continues with one less grab item being made available. Play continues in this manner until two players remain, at which point the player of the two having the lesser number of penalties is declared the winner. In an interesting way of playing the game under either of these two aspects, a player may pretend that the predetermined event, e.g., the collection of all the cards in a group, has occurred and fake a grab for one of the grab items. The first of any players to be fooled by such a fake is then penalized appropriately.

BRIEF DESCRIPTION OF THE DRAWING

The preferred embodiment contemplated for practicing the present invention will now be described in detail in conjunction with the drawing, which is a schematic view of the game pieces of the invention.

DESCRIPTION OF THE PREFERRED EMBODIMENT

As shown in the drawing, a game set according to the preferred embodiment of the invention includes a deck of fifty-two playing cards 10 with animals on one side and a decorative backing on the other side. The cards are grouped in sets 12 of four cards each, the cards in each set depicting the same farm animal and there being thirteen different animals depicted altogether. Twelve "grab items" 14, preferably thick and smooth like wooden "stones" or even spoons with a PIG emblem emblazoned thereon, are provided. Thirteen pig noses 16, which are fastened abound the players' heads and over their noses with elastic bands 18, thirteen right pig ears 20, and thirteen left pig ears 22 which fit over the players' ears are also provided.

The game is played as follows. The grab items 14 are placed in the center of a playing surface, with one less grab item than the number of players present being used. For example, if there are eight players, seven grab items are placed in the center of the playing surface.

The playing cards 10 are separated into the groups 12 of four of a kind, such as four ducks, four chickens, and so on until all of the animals are matched. In each game, there shall preferably be used the same number of groups 12 of cards as there are players. In other words, if there are four players, four groups 12 of cards (sixteen cards total) will be used, and the rest of the cards will be put aside. The cards to be used in the game are then shuffled and dealt in a clockwise manner until all of the cards are dealt. Thus, each player eventually will have four cards.

The dealer controls the play of the game. Each time the dealer commands "pass," everyone passes one card, e.g., to his or her left, and simultaneously receives a card, e.g., from his or her right. Therefore, each player will always have four cards in his hand. When someone has four cards in his hand that are the same, i.e., when he has all cards in a given group 12, he snatches a grab item 14 from the center of the playing surface. This is the signal, for everyone else to try to grab one of the grab items 14 as well. Because there is one less-grab item than the number of players present, however, one player will not be able to grab a grab item. The player who does not have a grab item when the grabbing is completed is assigned a letter of the Word "PIG" is required to put on and wear one of the pig appendages 16, 20, and then 22. The grab items are all put back in the center of the table, the cards are then reshuffled and redealt, and play continues as described above.

To make the game more exciting, a player may pretend he has four like cards and fake snatching a grab item as long as he does not touch one. If any of the other players is fooled and touches a grab item as a result of the fake, then the first one to be fooled and touch a grab item receives a letter and puts on a corresponding pig appendage piece.

Once a player has received all of the letters and the corresponding pig appendage pieces, the final "penalty" to be assigned is the dot on the "I," which signifies that the player is out of the game. When a player "PIGs" out, one group 12 of cards preferably is removed from the deck and a grab item 14 is removed from the center of the playing surface. Play again is continues as described above. This procedure is continued until there are only two players left. At that point, the player with the fewest letters or pig appendages on his body is the winner.

In another embodiment of the present invention, the appendages 16, 20, and 22 are other animal appendages. For example, a cow's, elephant's, cat's or a rabbit's nose and ears are used as the appendages 16, 20, and 22 respectively. In accordance with the present invention, appendages identifiable with any animal can be used as appendages 16, 20, and 22. In yet another embodiment of the present invention, the appendages can be non-animal parts worn on the head such as for example, a clown's hair, nose, ear's, etc. In still another embodiment of the present invention, the groups 12 of playing cards depict different fruits, colors, numbers, shapes, flowers, clowns or other non-animal pictures.

Other variations of this game will occur to those having skill in the art and are deemed to be within the scope of the following claims.

We claim:

1. A game apparatus, comprising:

a deck of game cards each bearing indicia on one side, said deck comprising a plurality of sets of game cards wherein each of the cards in a given set of game cards bears the same indicia, the indicia on the game cards in the different sets of game cards being different;

a plurality of hand-grabbable grab items capable of being quickly and easily grasped by a player, wherein the number of items is less than the number of sets of game cards; and a plurality of sets of wearable game pieces configured to be worn on a player's body, wherein the number of sets of same pieces equals the number of sets of game cards.

2. The game apparatus of claim 1, wherein said indicia comprise pictures of animals, the game cards in each group depicting the same animal and the game cards in different groups depicting different animals.

3. The game apparatus of claim 2, wherein said animals are farm animals.

4. The game apparatus of claim 1, wherein said wearable game pieces comprise representations of animal body parts.

5. The game apparatus of claim 4, wherein said wearable game pieces comprise representations of animal noses.

6. The game apparatus of claim 4, wherein said wearable game pieces comprise representations of animal ears.

7. The game apparatus of claim 1, wherein said wearable game pieces comprise representations of clown facial characteristics.

* * * * *